US012509860B2

(12) United States Patent
Ikeda et al.

(10) Patent No.: US 12,509,860 B2
(45) Date of Patent: Dec. 30, 2025

(54) CONTROL SYSTEM FOR LOADING MACHINE, CONTROL METHOD THEREFOR, AND LOADING MACHINE

(71) Applicant: KOMATSU LTD., Tokyo (JP)

(72) Inventors: Hiroaki Ikeda, Tokyo (JP); Shinichi Kitao, Tokyo (JP)

(73) Assignee: KOMATSU LTD., Tokyo (JP)

( * ) Notice: Subject to any disclaimer, the term of this patent is extended or adjusted under 35 U.S.C. 154(b) by 255 days.

(21) Appl. No.: 18/254,639

(22) PCT Filed: Oct. 25, 2021

(86) PCT No.: PCT/JP2021/039293

§ 371 (c)(1),
(2) Date: May 26, 2023

(87) PCT Pub. No.: WO2022/113602

PCT Pub. Date: Jun. 2, 2022

(65) Prior Publication Data

US 2024/0301664 A1 Sep. 12, 2024

(30) Foreign Application Priority Data

Nov. 27, 2020 (JP) ..... 2020-196924

(51) Int. Cl.
*E02F 9/26* (2006.01)
*E02F 3/43* (2006.01)

(52) U.S. Cl.
CPC ..... *E02F 9/265* (2013.01); *E02F 3/434* (2013.01); *E02F 3/439* (2013.01); *E02F 3/43* (2013.01); *E02F 9/26* (2013.01)

(58) Field of Classification Search
CPC . E02F 3/434; E02F 3/439; E02F 9/265; E02F 9/0875; E02F 9/2029; E02F 3/43; E02F 9/26
(Continued)

(56) References Cited

U.S. PATENT DOCUMENTS 6,609,315 B1 8/2003 Hendron et al.
7,752,778 B2 7/2010 Schoenmaker et al.
(Continued)

FOREIGN PATENT DOCUMENTS

CN 105766238 B * 8/2017 ..... A01D 41/02
JP 5-247965 A 9/1993
(Continued)

OTHER PUBLICATIONS

Palonen, Tuomo. "Augmented Reality Based Human Machine Interface for Semiautonomous Work Machines." (Year: 2016).*
(Continued)

*Primary Examiner* — Cuong H Nguyen
(74) *Attorney, Agent, or Firm* — GLOBAL IP COUNSELORS, LLP

(57) ABSTRACT

A loading machine has work equipment including a work tool and a movable support part configured to change a posture of the work tool. A control system for the loading machine includes a controller configured to determine presence or absence of a load, and a target work equipment posture indicating a target posture of the work tool based on a determination result of the presence or absence of the load.

11 Claims, 9 Drawing Sheets

(58) Field of Classification Search
USPC ..... 701/50, 53; 74/501.5 H
See application file for complete search history.

(56) References Cited

U.S. PATENT DOCUMENTS

| | | | | |
|---|---|---|---|---|
| 8,500,387 | B2 | 8/2013 | Trifunovic | |
| 2014/0019013 | A1 | 1/2014 | Liu et al. | |
| 2015/0330060 | A1* | 11/2015 | Seki | G01S 19/14 701/33.1 |
| 2016/0281323 | A1 | 9/2016 | Imaizumi | |
| 2017/0002540 | A1 | 1/2017 | Fletcher et al. | |
| 2018/0119384 | A1* | 5/2018 | Imaizumi | E02F 9/265 |
| 2018/0266071 | A1* | 9/2018 | Matsuyama | E02F 9/2004 |

FOREIGN PATENT DOCUMENTS

| | | | | | |
|---|---|---|---|---|---|
| JP | 8-189056 | A | | 7/1996 | |
| JP | 2000-105618 | A | | 4/2000 | |
| JP | 2004005186 | A | * | 1/2004 | |
| JP | 2004036327 | A | * | 2/2004 | |
| JP | 3725503 | B2 | * | 12/2005 | |
| JP | 3793739 | B2 | * | 7/2006 | |
| JP | 4076210 | B2 | * | 4/2008 | G03G 15/0848 |
| JP | 5308713 | B2 | * | 10/2013 | G07F 11/1653 |
| JP | 6781068 | B2 | * | 11/2020 | |
| JP | 7310595 | B2 | * | 7/2023 | E02F 9/205 |
| WO | 2016/152994 | A1 | | 9/2016 | |
| WO | 2017/126182 | A1 | | 7/2017 | |

OTHER PUBLICATIONS

Aromaa, Susanna, Vladimir Goriachev, and Tiina Kymäläinen. "Virtual prototyping in the design of see-through features in mobile machinery." Virtual Reality 24: 23-37 (Year: 2020).*

Padovani, Damiano, Massimo Rundo, and Gabriele Altare. "The working hydraulics of valve-controlled mobile machines: Classification and review." Journal of Dynamic Systems, Measurement, and Control 142.7 : 070801 (Year: 2020).*

Otsuki, Mai, et al. "Exploring Visual Augmentations for Improving the Operation of a Hydraulic Excavator using Expert Operation Replay." Proceedings of the 29th ACM Symposium on Virtual Reality Software and Technology. (Year: 2023).*

Tampier, C., Mascaró, M., & Ruiz-del-Solar, J. (2021). Autonomous loading system for load-haul-dump (lhd) machines used in underground mining. Applied Sciences, 11(18), 8718. (Year: 2021).*

Kawabe, Tomohito, Toshinobu Takei, and Etsujiro Imanishi. "Path planning to expedite the complete transfer of distributed gravel piles with an automated wheel loader." Advanced Robotics 35.23 (2021): 1418-1437. (Year: 2021).*

Wiens, Travis, Madison Klarkowski, and Nima Zahabi. "Development of a Physical Analog Excavator for Studies in Interactions Between Hydraulic Equipment and Human Operators." Fluid Power Systems Technology. vol. 83754. American Society of Mechanical Engineers, 2020. (Year: 2020).*

Li, Xuefei, et al. "Operating performance of pure electric loaders with different types of motors based on simulation analysis." Energies 14.3 (2021): 617. (Year: 2021).*

* cited by examiner

CONTROL SYSTEM FOR LOADING MACHINE, CONTROL METHOD THEREFOR, AND LOADING MACHINE

CROSS-REFERENCE TO RELATED APPLICATION(S)

This application is a U.S. National stage application of International Application No. PCT/JP2021/039293, filed on Oct. 25, 2021. This U.S. National stage application claims priority under 35 U.S.C. § 119(a) to Japanese Patent Application No. 2020-196924, filed in Japan on Nov. 27, 2020, the entire contents of which are hereby incorporated herein by reference.

BACKGROUND

Technical Field

The present invention relates to a control system for a loading machine, a control method therefor, and a loading machine.

Background Information

Japanese Unexamined Patent Application, First Publication No. 2000-105618 discloses a lever type signal generation device that generates a control signal in accordance with an amount of tilting of an operation lever by tilting the operation lever. Also, this lever type signal generation device has functions of maintaining the operation lever in a tilted state and returning the tilted state to a neutral state in response to a signal from a predetermined sensor or the like in a case in which the operation lever reaches an end of a stroke. For this reason, according to this lever type signal generation device, after the operation lever reaches the end of the stroke, control signals in accordance with the amount of tilting and a tilting direction of the operation lever are continuously output even if an operator releases the operation lever. For this reason, for example, in the case of operating work equipment of a wheel loader with this lever type signal generation device, the operator can concentrate on a running operation of the wheel loader at the time of simultaneously performing a plurality of different operations such as raising the work equipment while running the wheel loader.

SUMMARY

As described above, according to the lever type signal generation device described in Japanese Unexamined Patent Application, First Publication No. 2000-105618, if the operation lever is tilted until the tilted state is maintained, a work tool such as a bucket can be moved to a predetermined height and automatically stopped even after the lever is released.

Incidentally, according to a certain work cycle, the wheel loader excavates an excavation target such as earth with a work tool such as a bucket, then raises the work tool that has scooped up excavated material, and loads it onto a transport vehicle or the like. After that, the work tool is lowered and placed in an excavation posture, and the excavation target and the excavated material are scooped up again. In such a work cycle, for example, if a posture of the work tool can be automatically changed to the excavation posture in response to the operation of lowering the work tool, the operation can be labor-saving. However, the operation of lowering the work tool that is being raised may be performed not only in a case in which the work tool is in an empty state, but also in a case in which the work tool is in a loaded state. If the posture of the work tool is automatically changed to the excavation posture in the case of the loaded state, the excavated material may spill out inappropriately.

The present invention has been made in view of the above circumstances, and an object thereof is to provide a control system for a loading machine, a control method therefor, and a loading machine in which a target posture of a work tool can be appropriately determined in a case in which a posture of the work tool is automatically controlled.

One aspect of the present invention is a control system for a loading machine, which has work equipment that includes a work tool and a movable support part configured to change a posture of the work tool, including a controller. The controller is programmed to do the following processing. The controller determines presence or absence of a load in the work tool. The controller determines a target work equipment posture indicating a target posture of the work tool on the basis of the determination result regarding the presence or absence of a load.

A second aspect of the present invention is a method performed by a controller for controlling a loading machine, which has work equipment that includes a work tool and a movable support part configured to change a posture of the work tool, including the following steps. A first step is to determine presence or absence of a load in the work tool. A second step is to determine a target work equipment posture indicating a target posture of the work tool on the basis of the determination result regarding the presence or absence of a load.

A third aspect of the present invention is a work vehicle, which includes work equipment including a work tool and a movable support part configured to change a posture of the work tool, an operation unit configured to operate the movable support part, and a controller. The controller is programmed to do the following processing. The controller determines presence or absence of a load in the work tool. The controller determines a target work equipment posture indicating a target posture of the work tool on the basis of the determination result regarding the presence or absence of a load in a case in which a predetermined operation is performed on the operation unit. The controller outputs a command to control the movable support part to achieve the target work equipment posture.

According to the present invention, it is possible to provide the control system for a loading machine, the control method therefor, and the loading machine in which the target posture of the work tool can be appropriately determined in the case in which the posture of the work tool is automatically controlled.

DETAILED DESCRIPTION OF EMBODIMENT(S)

Figure 1:
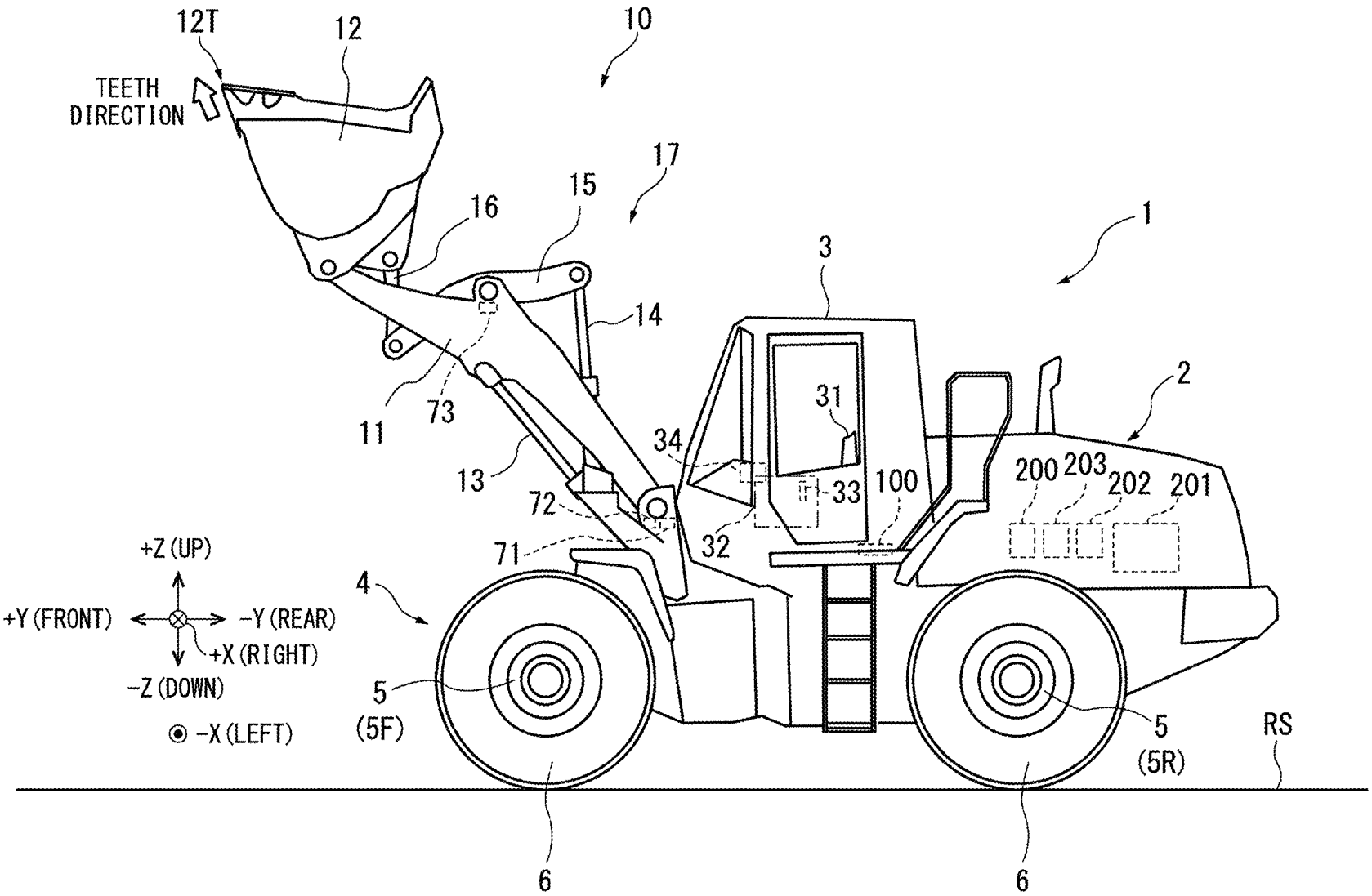
FIG. 1 is a side view showing a loading machine according to an embodiment.

Embodiments according to the present disclosure will be described below with reference to the drawings. Also, in each figure, the same reference numerals will be used for the same or corresponding configurations, and the description thereof will be omitted as appropriate.

In the present embodiments, a local coordinate system is set in a loading machine 1, and positional relationships between respective parts will be described with reference to the local coordinate system. In the local coordinate system, a first axis extending in a lateral direction (a vehicle width direction) of the loading machine 1 is defined as an X axis, a second axis extending in a longitudinal direction of the loading machine 1 is defined as a Y axis, and a third axis extending in a vertical direction of the loading machine 1 is defined as a Z axis. The X axis and the Y axis are orthogonal to each other. The Y axis and the Z axis are orthogonal to each other. The Z axis and the X axis are orthogonal to each other. +X direction is a rightward direction and −X direction is a leftward direction. +Y direction is a forward direction and −Y direction is a backward direction. +Z direction is an upward direction and −Z direction is a downward direction.

(Overview of Loading Machine)

FIG. 1 is a side view showing a loading machine 1 according to an embodiment. The loading machine 1 according to the embodiment is, for example, a wheel loader. In the following description, the loading machine 1 will be called a wheel loader 1 as appropriate.

As shown in FIG. 1, the wheel loader 1 has a vehicle body 2, a cab 3, a running mechanism 4, and work equipment 10. The wheel loader 1 runs in a work site using the running mechanism 4. The wheel loader 1 performs work using the work equipment 10 in the work site. Using the work equipment 10, the wheel loader 1 can perform works such as excavation work, loading work, transportation work, and snow removal work.

The cab 3 is supported by the vehicle body 2. A driver's seat 31 on which an operator sits, an operation device 32, and an input display unit 34, which will be described later, are disposed inside the cab 3.

The running mechanism 4 has rotatable wheels 5. The wheels 5 support the vehicle body 2. The wheel loader 1 can run on a road surface RS using the running mechanism 4. Also, FIG. 1 shows only a left front wheel 5F and a left rear wheel 5R.

The work equipment 10 is supported by the vehicle body 2. The work equipment 10 includes a bucket 12 serving as an example of the work tool, and a movable support part 17 that changes a position and a posture of the bucket 12. In the example shown in FIG. 1, the movable support part 17 includes a boom 11, a pair of boom cylinders 13, a bucket cylinder 14, a bell crank 15, and a link 16.

The boom 11 is rotatably supported with respect to the vehicle body 2 and moves in the vertical direction as shown in FIGS. 1 to 4 in accordance with expansion and contraction of the boom cylinders 13. The boom cylinders 13 are actuators that generate power for moving the boom 11, of which one end portions are connected to the vehicle body 2 and the other end portions are connected to the boom 11. When the operator operates a boom operation device 33, the boom cylinders 13 expand and contract. Thus, the boom 11 moves in the vertical direction. The boom cylinders 13 are, for example, hydraulic cylinders.

The bucket 12 is a work tool that has teeth 12T and is for excavating and loading an excavation target such as earth. The bucket 12 is rotatably connected to the boom 11 and rotatably connected to one end portion of the link 16. The other end portion of the link 16 is rotatably connected to one end portion of the bell crank 15. The bell crank 15 has a central portion rotatably connected to the boom 11 and the other end portion rotatably connected to one end portion of the bucket cylinder 14. The other end portion of the bucket cylinder 14 is rotatably connected to the vehicle body 2. The bucket 12 is operated by power generated by the bucket cylinder 14. The bucket cylinder 14 is an actuator that generates the power for moving the bucket 12. When the operator operates a predetermined work equipment lever, the bucket cylinder 14 expands and contracts. Thus, the bucket 12 swings. The bucket cylinder 14 is, for example, a hydraulic cylinder. The teeth 12T have shapes such as flat blades or flat blades and are replaceably attached to the end portion of the bucket 12.

Figure 2:
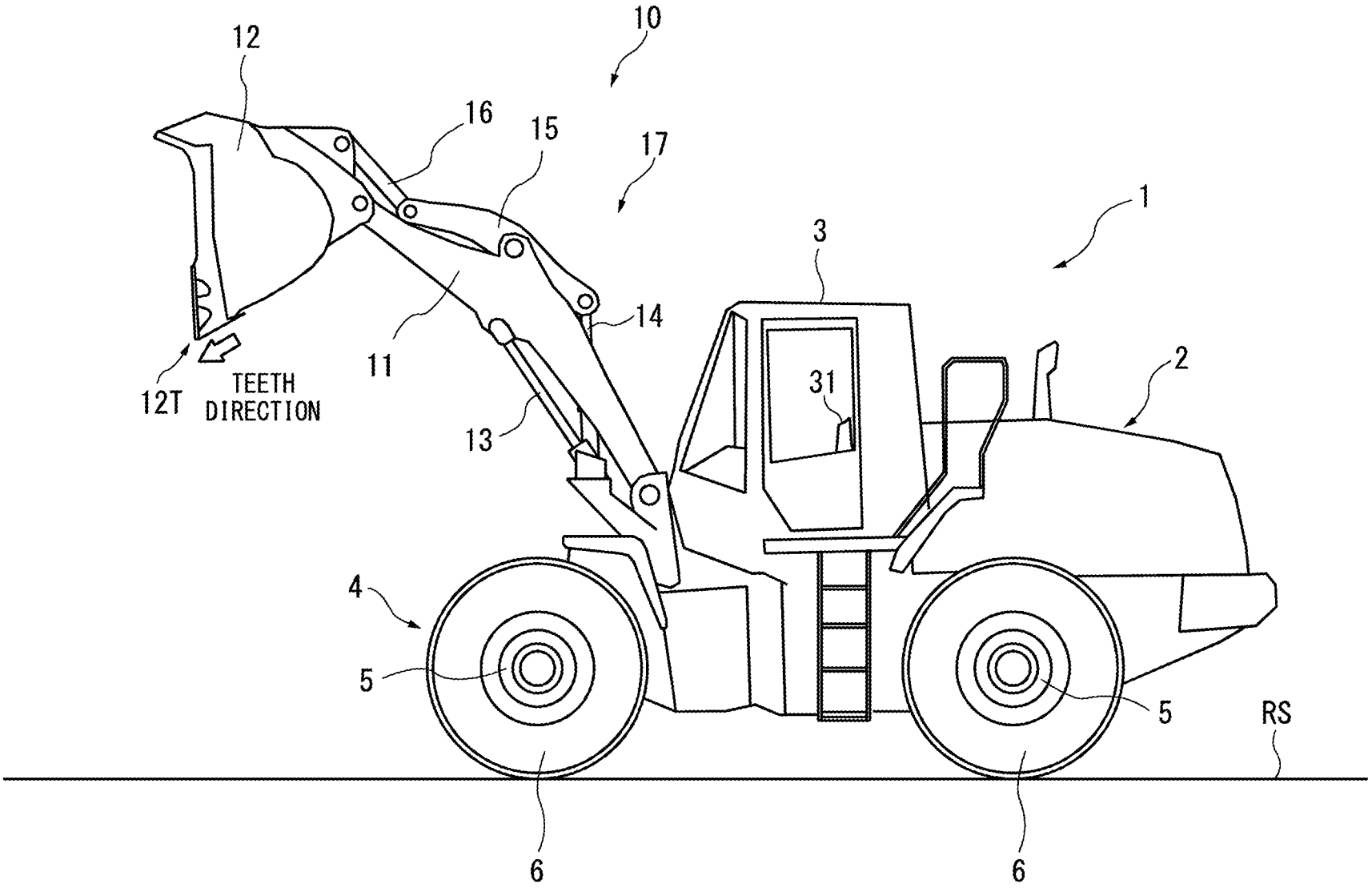
FIG. 2 is a side view showing an operation example of the loading machine according to the embodiment.
Figure 3:
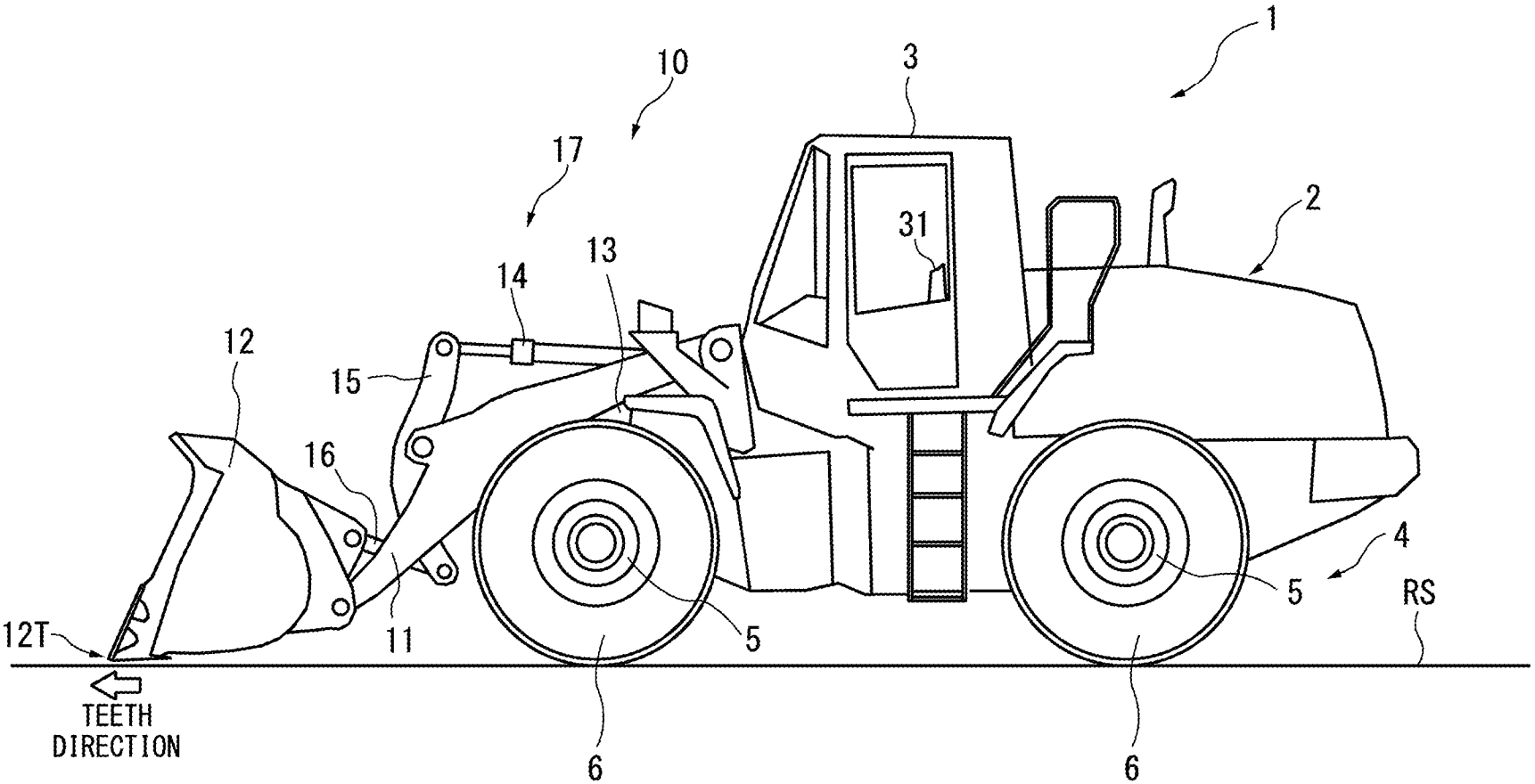
FIG. 3 is a side view showing another operation example of the loading machine according to the embodiment.
Figure 4:
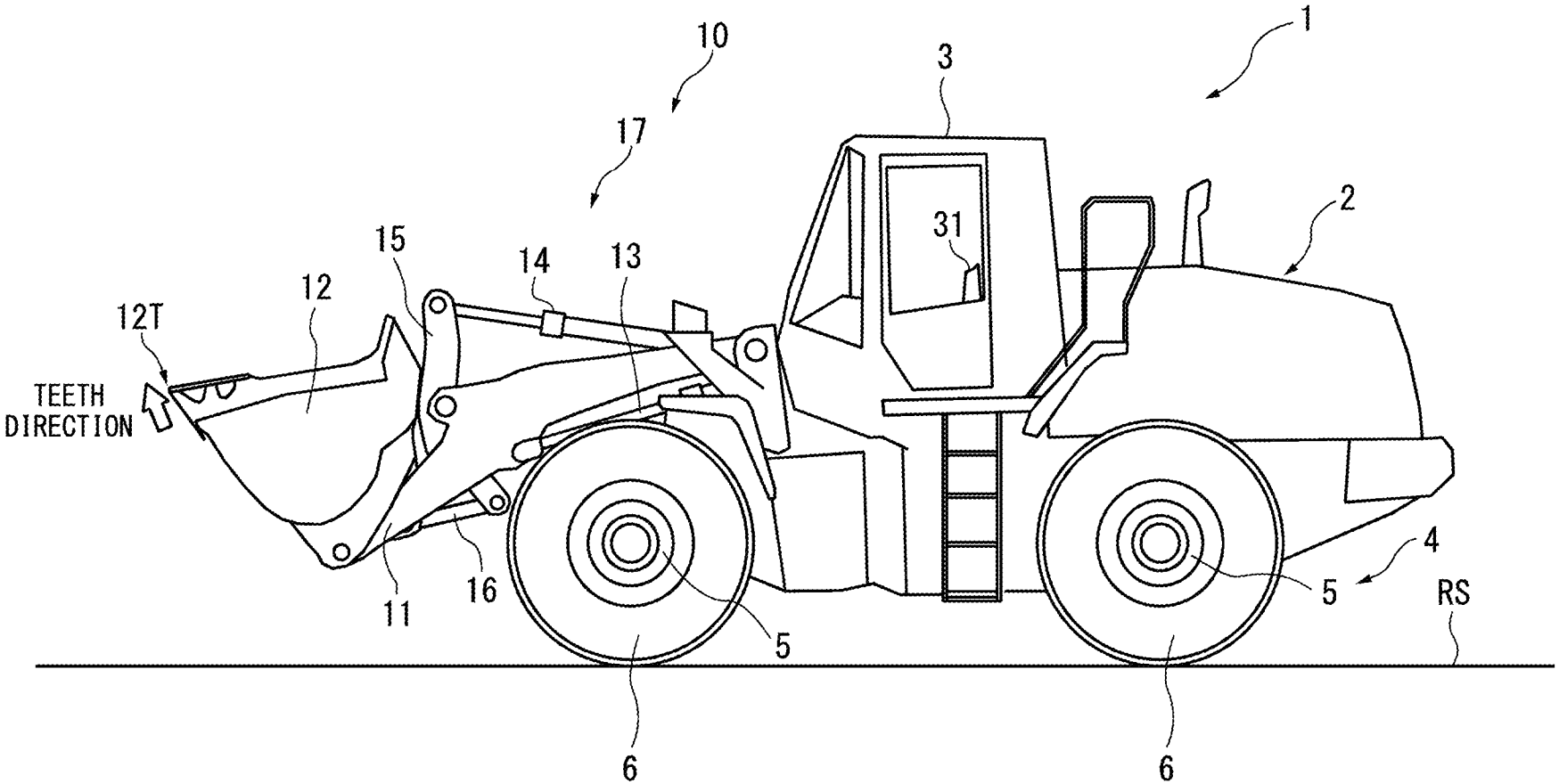
FIG. 4 is a side view showing another operation example of the loading machine according to the embodiment.

Also, in the present embodiment, the posture of the bucket 12 in which the teeth 12T face downward as shown in FIG. 2 is referred to as a dump posture. The dump posture is, for example, a posture in which excavated material in the bucket 12 can be loaded onto a transport vehicle or the like. In addition, as shown in FIG. 3, the posture of the bucket 12 in which the teeth 12T are oriented in a parallel direction (including a substantially parallel direction) to the road surface RS is referred to as an excavation posture (or a running posture during excavation). The excavation posture is, for example, a posture at the time of starting excavation of the excavation target such as earth or running toward the excavation target (or a posture suitable for starting excavation or running). Further, the posture of the bucket 12 in which the teeth 12T faces upward as shown in FIG. 4 is referred to a holding posture (a tilt posture). The holding posture is, for example, a posture in which the excavated material can be held in the bucket 12. For example, the wheel loader 1 takes the bucket 12 in the excavation posture (or in a posture in which the teeth 12T are lower than the road surface RS from the excavation posture) and runs forward to start excavating the excavation target located in front. Also, the excavation posture of the wheel loader 1 can also be called a horizontal posture because teeth directions are substantially parallel to the road surface RS.

(Configuration of Control System)

Figure 5:
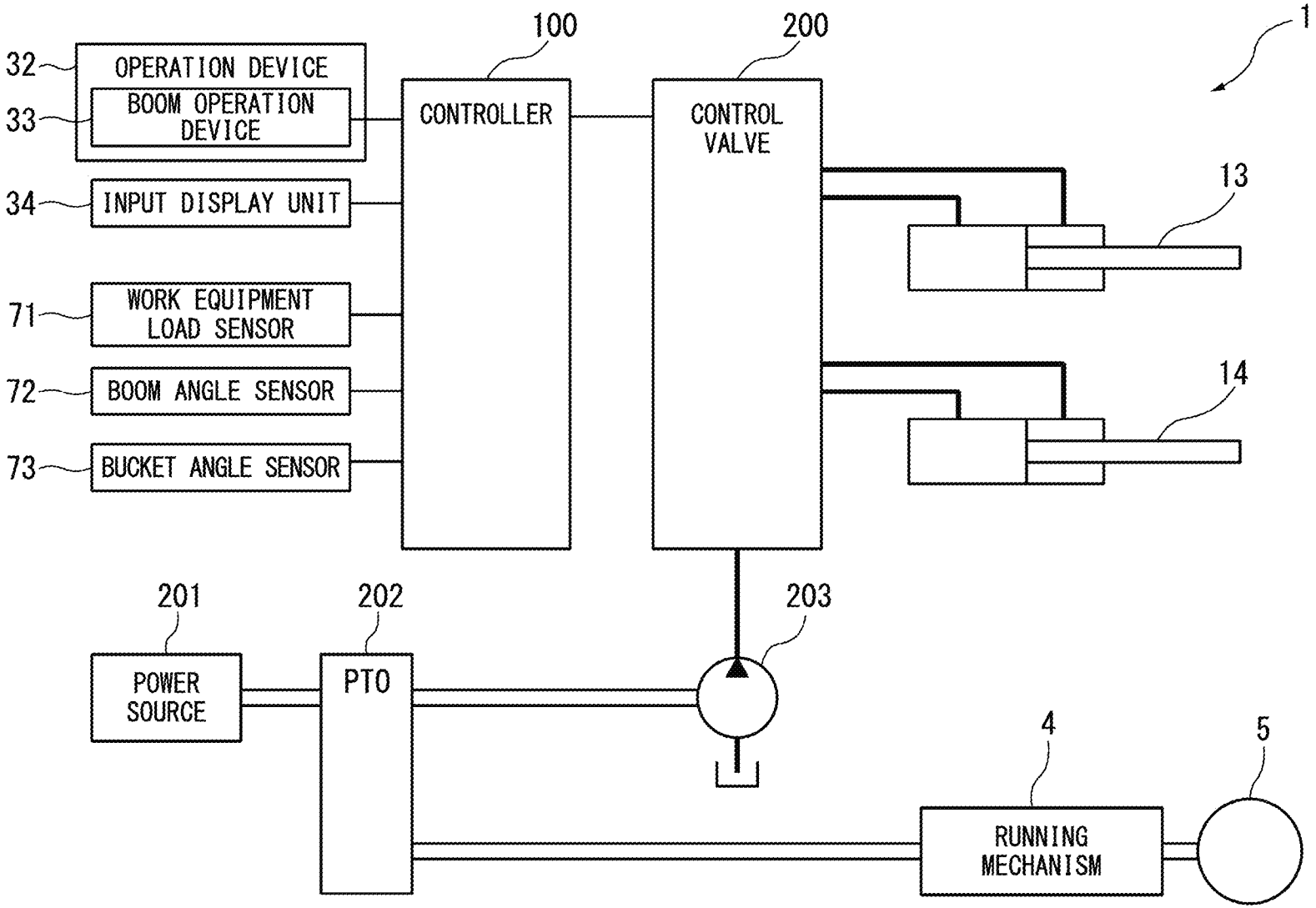
FIG. 5 is a block diagram showing a configuration example of a control system for a loading machine according to the embodiment.

FIG. 5 is a block diagram showing a configuration example of a control system for the wheel loader 1 according to the embodiment. As shown in FIG. 5, the wheel loader 1 includes a power source 201, a power take off (PTO) 202, a hydraulic pump 203, a control valve 200, the operation device 32, the input display unit 34, and a controller 100.

The power source 201 generates a driving force for operating the loading machine. Examples of the power source include an internal combustion engine and an electric motor.

The PTO 202 transmits at least part of the driving force of the power source 201 to the hydraulic pump 203. The PTO 202 distributes the driving force of the power source 201 to the running mechanism 4 and the hydraulic pump 203.

The hydraulic pump 203 is driven by the power source 201 and discharges hydraulic oil. At least part of the hydraulic oil discharged from the hydraulic pump 203 is supplied to each of the boom cylinder 13 and the bucket cylinder 14 via the control valve 200. The control valve 200 controls flow rates and directions of the hydraulic oil supplied from the hydraulic pump 203 to each of the boom cylinder 13 and the bucket cylinder 14. The work equipment 10 is operated by the hydraulic oil from the hydraulic pump 203.

The operation device 32 is disposed inside the cab 3. The operation device 32 is operated by the operator. The operator operates the operation device 32 to perform adjustment of a traveling direction and a running speed of the wheel loader 1, switch between forward and reverse travel, and operations of the work equipment 10. The operation device 32 includes, for example, a steering, a shift lever, an accelerator pedal, a brake pedal, and the boom operation device 33 for operating the boom 11 of the work equipment 10. The input display unit 34 is configured of a combination of an input device and a display device, an input display device such as a touch panel, or the like. The operator uses the input display unit 34 to set, for example, storage values of a target position and a target posture for controlling the work equipment 10, which will be described later.

Figure 6:
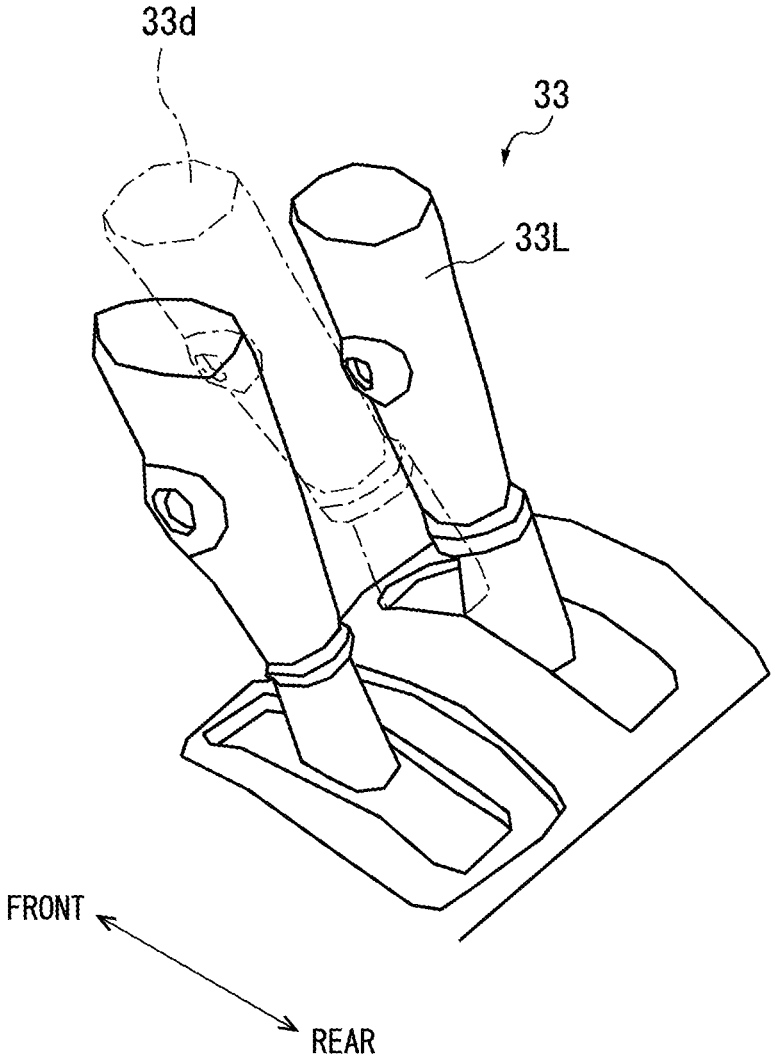
FIG. 6 is a perspective view showing a configuration example of a boom operation device according to the embodiment.

FIG. 6 is a configuration diagram showing the boom operation device 33 according to the embodiment. As shown in FIG. 6, the boom operation device 33 includes an operation lever 33L that can be tilted from a neutral position. The boom operation device 33 is, for example, a lever type signal generation device described in Japanese Unexamined Patent Application, First Publication No. 2000-105618, includes the operation lever 33L, and has a holding mechanism that holds the operation lever 33L at a tilted position 33*d*. The tilted position 33*d* is, for example, a position at which the operation lever 33L reaches an end of a stroke.

The boom operation device 33 outputs control signals corresponding to a tilting direction and an amount of tilting of the operation lever 33L. In addition, the boom operation device 33 outputs a predetermined operation pattern signal indicating a case in which the operation lever 33L is held at the tilted position 33*d* by the holding mechanism. Also, in the present embodiment, a state in which the operation lever 33L is held at the tilted position 33*d* is referred to as a tilt holding state.

In a case in which a return instruction signal is input, the boom operation device 33 returns the operation lever 33L from the tilt holding state to a neutral state. The return instruction signal is, for example, a signal indicating that an angle of the boom 11 or an angle of the bell crank 15, which will be described later, has reached a predetermined angle, or that the boom cylinder 13 or the bucket cylinder 14, which will be described later, has reached a predetermined length.

Also, the boom operation device 33 may be an operation lever that does not have a holding function of holding the operation lever at the tilted position 33*d*, for example. A case in which an operation of tilting the operation lever to the end of the stroke is performed may be regarded as a case in which an operation of holding the operation lever 33L at the tilted position 33*d* (atilt holding operation) is performed. In this case, when the operator's hand is released from the operation lever, the operation lever returns to the neutral state, a predetermined operation pattern signal can be output assuming that the tilt holding state continues until a position and a posture of the work equipment 10 reach a predetermined state. Alternatively, the operation device 32 may be provided with a predetermined operation element such as a push button corresponding to a boom-down holding operation. A case in which an operation of pressing the push button or the like is performed may be regarded as a case in which the tilt holding operation is performed.

Further, the wheel loader 1 has a work equipment load sensor 71, a boom angle sensor 72, and a bucket angle sensor 73.

The work equipment load sensor 71 detects a load applied to the work equipment 10. The work equipment load sensor 71 is, for example, a load measurement device such as a strain gauge or a load cell arranged on at least a part of the work equipment 10. Load data detected by the work equipment load sensor 71 is output to the controller 100. Also, the load applied to the work equipment 10 may be detected using, for example, a hydraulic sensor for detecting a pressure of hydraulic oil that drives the boom cylinder 13 or a hydraulic sensor for detecting a pressure of hydraulic oil that drives the bucket cylinder 14. In this case, the load applied to the work equipment 10 changes depending on whether the excavated material is held by the bucket 12 or not. The work equipment load sensor 71 can detect presence or absence of the excavated material held in bucket 12 by detecting a change in the load applied to the work equipment 10.

The boom angle sensor 72 detects the angle of the boom 11 with respect to the vehicle body 2 and outputs detected data to the controller 100. The boom angle sensor 72 is, for example, an angle sensor disposed at a connection portion between the vehicle body 2 and the boom 11. Also, the angle of the boom 11 may be calculated from an amount of a stroke of the boom cylinder 13.

The bucket angle sensor 73 is a sensor for detecting an angle of the bucket 12. The bucket angle sensor 73 is, for example, an angle sensor disposed at a connection portion between the boom 11 and the bell crank 15. The bucket angle sensor 73 detects the angle of the bell crank 15 with respect to boom 11 and outputs detected data to the controller 100. The angle of the bucket 12 with respect to the boom 11 (and the vehicle body 2) can be calculated on the basis of the angle of the boom 11 with respect to the vehicle body 2 detected by the boom angle sensor 72 and the angle of the bell crank 15 with respect to the boom 11 detected by the bucket angle sensor 73. Also, the angle of the bucket 12 with respect to the boom 11 may be detected using a sensor that detects the angle of the bucket 12 with respect to the boom 11 at a connection portion between the bucket 12 and the boom 11, for example. In addition, the angle of the bell crank 15 with respect to the boom 11 and the angle of the bucket 12 with respect to the boom 11 may be calculated from the amount of the stroke of the boom cylinder 13 and an amount of a stroke of the bucket cylinder 14.

(Configuration of Controller)

Figure 7:
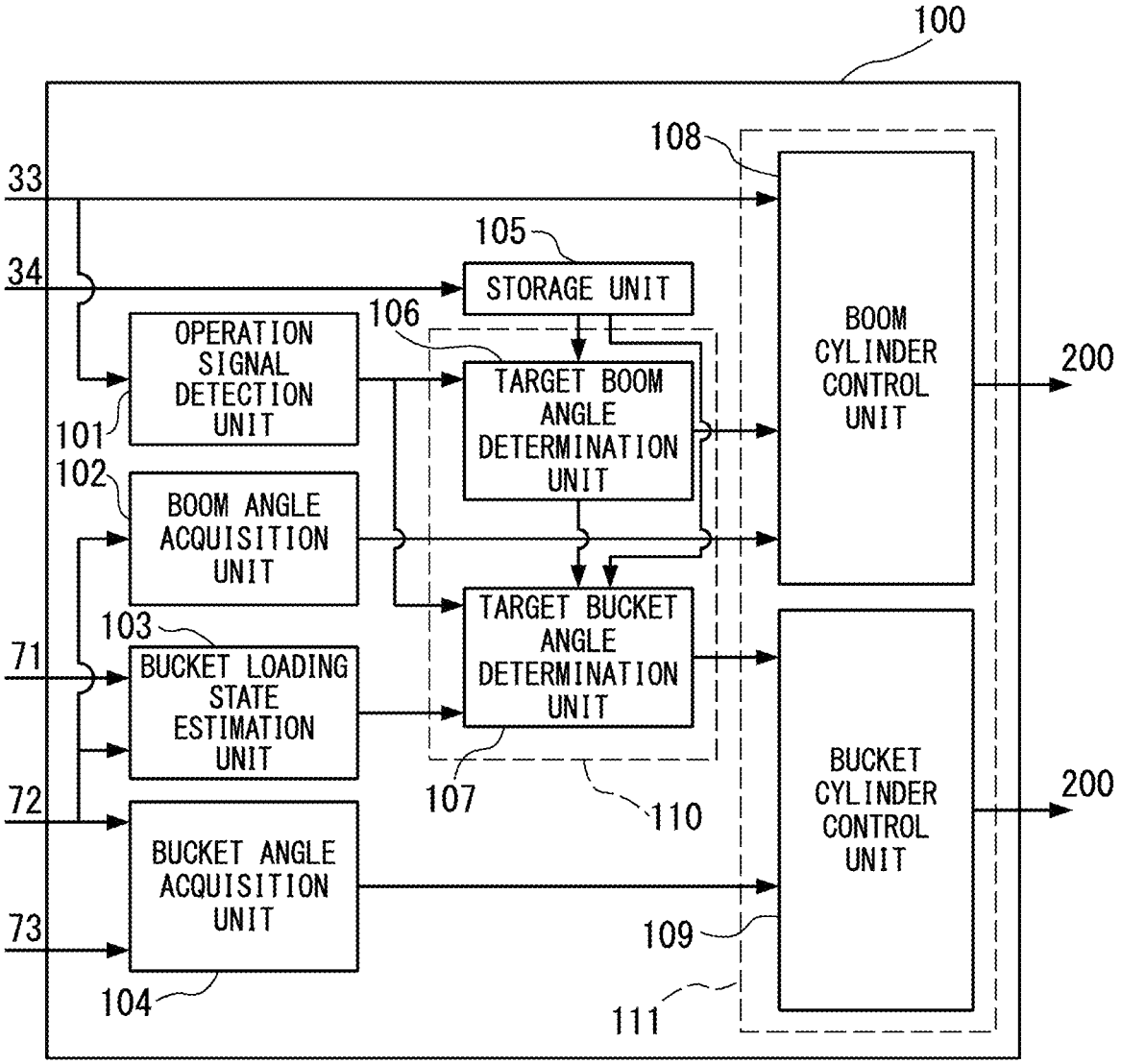
FIG. 7 is a schematic block diagram showing a configuration of a controller according to the embodiment.

FIG. 7 is a configuration diagram showing the controller 100 of the wheel loader 1 according to the embodiment. The controller 100 is configured using, for example, a field programmable gate array (FPGA) or microcomputer having a processor, a main storage device, an auxiliary storage device, an input and output device, and the like. The controller 100 includes, as a functional configuration including hardware or a combination of hardware and software such as a program, an operation signal detection unit 101, a boom angle acquisition unit 102, a bucket loading state estimation unit 103, a bucket angle acquisition unit 104, a storage unit 105, a target boom angle determination unit 106, a target bucket angle determination unit 107, a boom cylinder control unit 108, and a bucket cylinder control unit 109. Also, the target boom angle determination unit 106 and the target bucket angle determination unit 107 constitute a determination unit 110. In addition, the boom cylinder control unit 108 and the bucket cylinder control unit 109 constitute a control unit 111.

The controller 100 of the present embodiment is a device that controls the work equipment 10 having the bucket 12 and the movable support part 17 for changing the position and the posture of the bucket 12. In addition, the controller 100 includes the bucket loading state estimation unit 103 (a determining unit) that determines presence or absence of a load in the bucket 12 and the determination unit 110 that determines a target work equipment posture indicating a target position and a target posture in control of the bucket 12 on the basis of the determination result on the presence or absence of the load. Further, the controller 100 includes the control unit 111 that controls the work equipment 10 to achieve the target work equipment posture.

Also, FIG. 7 shows only a configuration corresponding to control according to an operation of the boom operation device 33 of the operation device 32 (operation unit) among functions of the controller 100. Further, in an operation example of the controller 100 described later, in control according to operations of the boom operation device 33, a case in which an operation of bringing the boom operation device 33 shown in FIG. 6 into the tilt holding state that the boom operation device 33 is tilted forward (a state in which the operation lever 33L is held at the tilted position 33*d*) is performed (referred to as the boom-down holding operation) will be described.

Figures 8A, 8B:
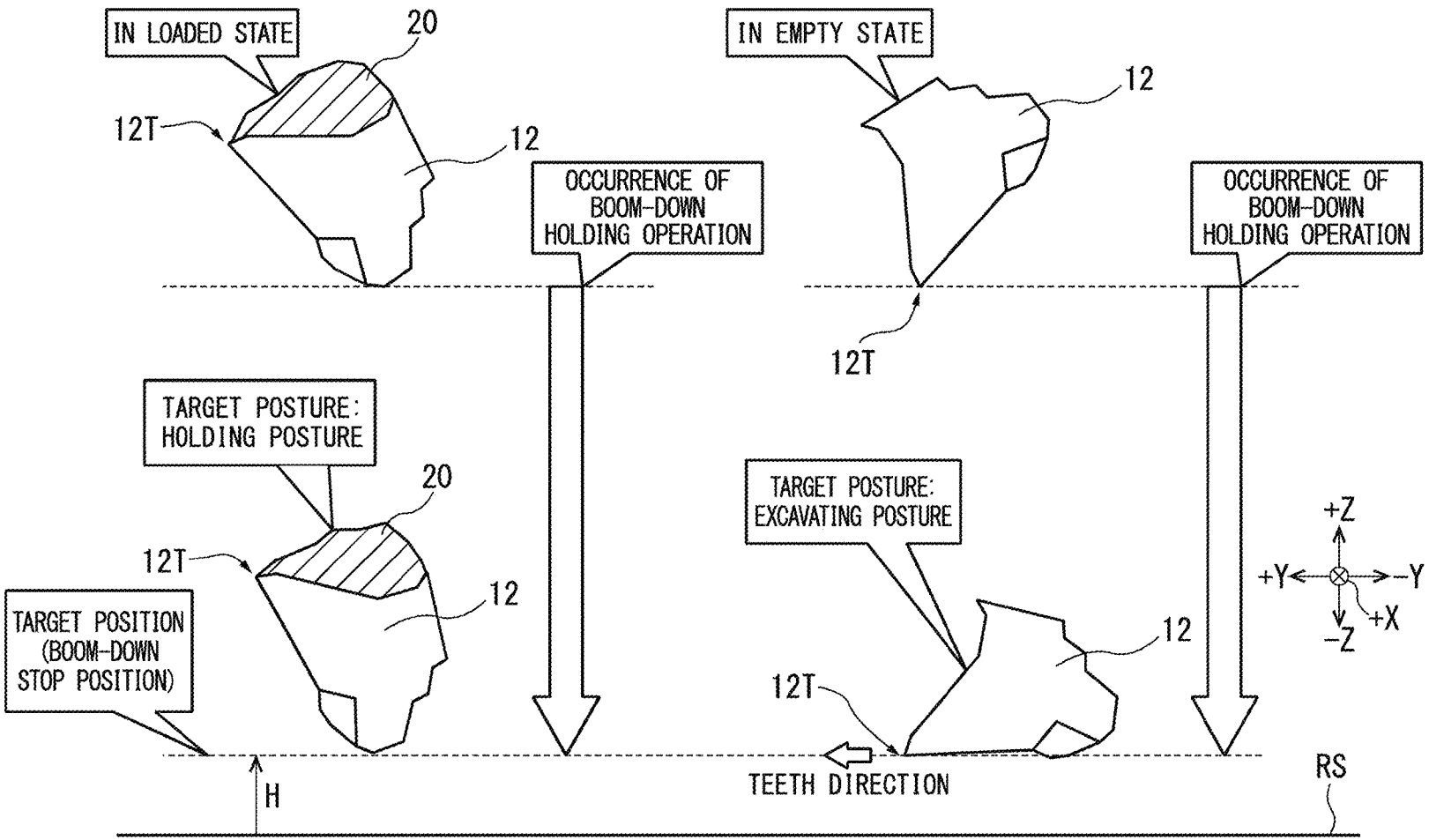
FIG. 8A and FIG. 8B are a schematic diagrams showing an operation example of the loading machine according to the embodiment.

For example, when the boom-down holding operation is performed on the boom operation device 33, the determination unit 110 determines the target work equipment posture such that the bucket 12 is in the holding posture when there is a load, and determines the target work equipment posture such that the bucket 12 is in the excavating posture when there is no load. FIG. 8A and FIG. 8B show a determination example of the target work equipment posture by determination unit 110. FIG. 8A shows a determination example of the target work equipment posture (the target position and the target posture) in a case in which the boom-down holding operation is performed on the boom operation device 33 in the work equipment posture shown in FIG. 1 (assuming a loaded state (a state in which there is a load 20)). In this case, the target posture is the holding posture, and the target position is a boom-down stop position, which is a position at a height H (for example, the lowest height of the bucket 12) from the road surface RS. In addition, FIG. 8B shows a determination example of the target work equipment posture (the target position and the target posture) in a case in which the boom-down holding operation is performed in the work equipment posture shown in FIG. 2 (an empty state (a state in which there is no load 20)). In this case, the target posture is the excavation posture, and the target position is the boom-down stop position at the height H (for example, the lowest height of the bucket 12) from the road surface RS.

The control unit 111 controls the work equipment 10 in accordance with an manual operation of the boom operation device 33, and controls the work equipment 10 to achieve the target work equipment posture determined by the determination unit 110 in a case in which the boom-down holding operation is performed. In the case in which the boom-down holding operation is performed, the control unit 111 adjusts, for example, a boom cylinder length, which is a length of the boom cylinder 13, and a bucket cylinder length, which is a length of the bucket cylinder 14, to achieve the target work equipment posture. In the example shown in FIG. 7, the control unit 111 controls the boom cylinder length by outputting a predetermined control signal (referred to as a boom cylinder command) to the control valve 200 so that a current work equipment posture becomes the target work equipment posture and controls the bucket cylinder length by outputting a predetermined control signal (referred to as a bucket cylinder command) to the control valve 200.

The operation signal detection unit 101 receives an operation signal from the boom operation device 33 in the operation device 32 and outputs a signal indicating that the boom-down holding operation has been performed in a case in which the boom down holding operation has been performed. The operation signal detection unit 101 may continuously output the signal indicating that the boom-down holding operation has been performed, for example, during holding the tilted state, or may output at a timing of start or end of the tilted state.

The boom angle acquisition unit 102 receives data detected by the boom angle sensor 72 and acquires a current boom angle. The boom angle acquisition unit 102 outputs the acquired current boom angle data to the boom cylinder control unit 108. The current boom angle data may be, for example, data indicating a current boom cylinder length.

The bucket loading state estimation unit 103 receives a signal from the work equipment load sensor 71 and a signal from the boom angle sensor 72 to estimate a work equipment load. Further, the bucket loading state estimation unit 103 compares the estimated work equipment load with a predetermined threshold, determines that there is a load in a case in which the work equipment load exceeds the threshold, and determines that there is no load in a case in which the work equipment load does not exceed the threshold. Then, the bucket loading state estimation unit 103 outputs the determination result to the target bucket angle determination unit 107.

The bucket angle acquisition unit 104 receives the data detected by the boom angle sensor 72 and the data detected by the bucket angle sensor 73 to acquire a current bucket angle. The bucket angle acquisition unit 104 outputs the acquired current bucket angle data to the bucket cylinder control unit 109. The current bucket angle data may be, for example, data indicating a current bucket cylinder length.

The storage unit 105 stores each of set values and initial values of the target work equipment posture (the target position and the target posture) when there is a load set and no load, using the input display unit 34, as storage values. The storage values of the target position can be, for example, numerical values indicating heights from the road surface RS (the boom-down stop position, and the like). Also, the storage values of the target posture can be, for example, identification codes indicating postures such as the excavating posture, the holding posture, the dumping posture, and the like or angle information indicating the teeth directions. Further, the target position when there is a load may be the same as or different from that when there is no load.

In the case in which the boom-down holding operation is performed, the target boom angle determination unit 106 determines the target boom angle, which is a target value of the boom angle, on the basis of the target position stored in the storage unit 105, and outputs the determined target boom angle data to the boom cylinder control unit 108. This target boom angle is a target value valid only while the boom-down holding operation is being performed. In addition, in the operation example below, in the case in which the boom-down holding operation is performed, regardless of presence or absence of the load, the target boom angle determination unit 106 determines the target boom angle on the basis of the boom-down stop position stored in the storage unit 105. The target boom angle data may be, for example, data indicating a target boom cylinder length, which is a target value of the boom cylinder length.

In the case in which the boom-down holding operation is performed, the target bucket angle determination unit 107 determines the target bucket angle, which is a target value of the bucket angle, on the basis of the determination result of whether or not there is a load, the storage value of the target position and the storage value of the target posture stored in the storage unit 105, and the target boom angle data determined by the target boom angle determination unit 106, and outputs the determined target bucket angle data to the bucket cylinder control unit 109. This target bucket angle is a target value valid only while the boom-down holding operation is being performed. The target bucket angle data may be, for example, data indicating a target bucket cylinder length, which is a target value of the bucket cylinder length.

In a case in which the boom-down holding operation is not performed on the boom operation device 33, the boom cylinder control unit 108 calculates a boom cylinder flow rate corresponding to the manual operation of the boom operation device 33, and outputs the boom cylinder command so that a flow rate in the control valve 200 becomes a target boom cylinder flow rate. In addition, in the case in which the boom-down holding operation is performed on the boom operation device 33, the boom cylinder control unit 108 calculates the target boom cylinder flow rate on the basis of a deviation between the current boom angle acquired by the boom angle acquisition unit 102 and the target boom angle determined by the target boom angle determination unit 106, and outputs the boom cylinder command on the basis of the target boom cylinder flow rate.

In the case in which the boom-down holding operation is performed on the boom operation device 33, the bucket cylinder control unit 109 calculates a target bucket cylinder flow rate on the basis of a deviation between the current bucket angle acquired by the bucket angle acquisition unit 104 and the target bucket angle determined by the target bucket angle determination unit 107, and outputs the bucket cylinder command on the basis of the target bucket cylinder flow rate.

(Operation Example of Controller)

Figure 9:
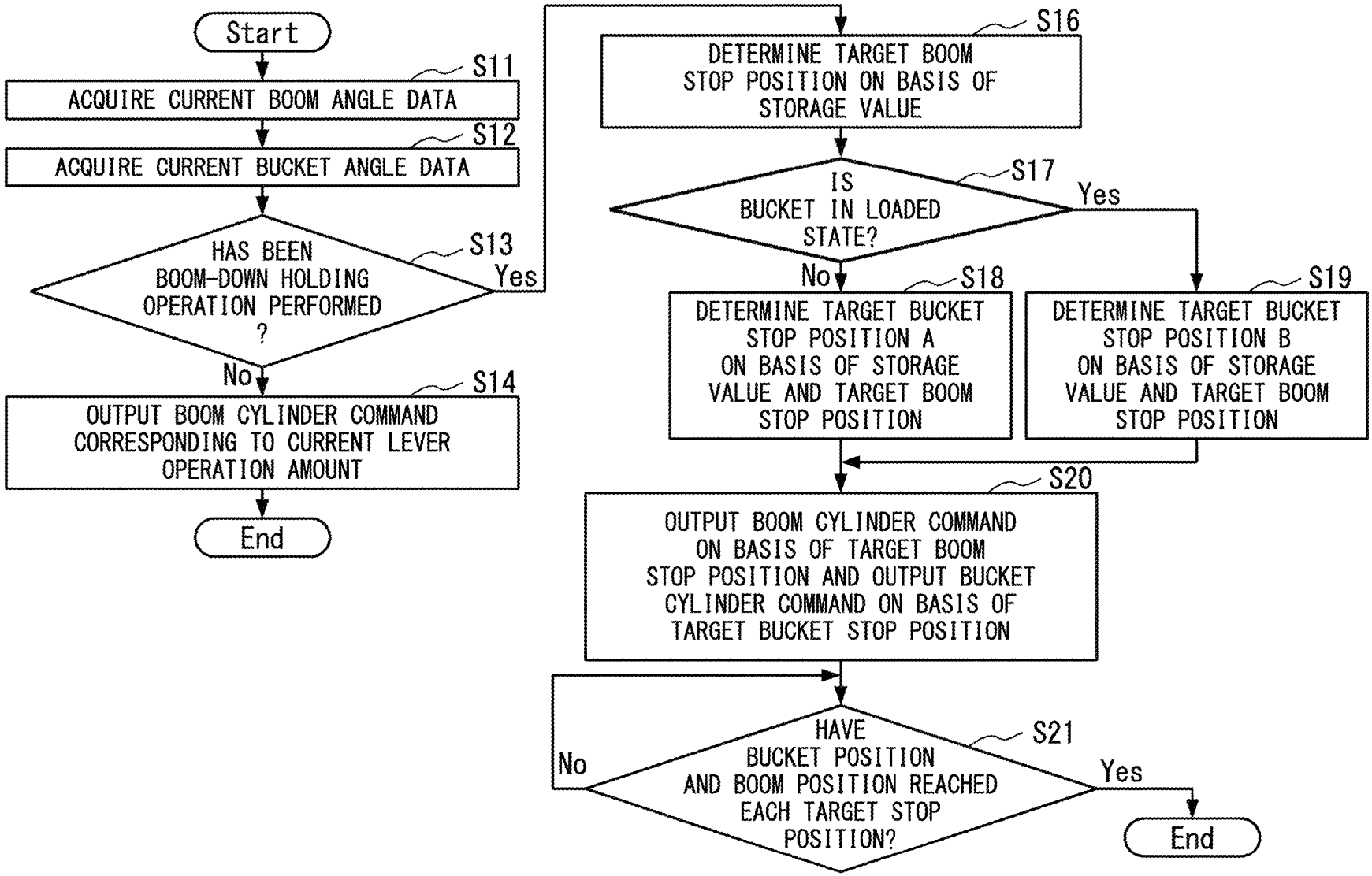
FIG. 9 is a flowchart showing an operation example of the controller according to the embodiment.

FIG. 9 is a flowchart showing an operation example of the controller 100 according to the embodiment. The processing shown in FIG. 9 is repeatedly executed at a predetermined cycle. In step S11, the controller 100 acquires the current boom angle from the signal from the boom angle sensor 72.

In step S12, the controller 100 acquires the current bucket angle from the signal from the boom angle sensor 72 and the signal from the bucket angle sensor 73.

In step S13, the controller 100 determines whether or not the boom-down holding operation of the boom operation device 33 has been performed. The controller 100 determines whether or not the boom-down holding operation has been performed on the basis of the signal from the boom operation device 33 indicating that the boom-down holding operation has been performed. In a case in which the controller 100 determines that the boom-down holding operation has not been performed ("No" in step S13), in step S14, the controller 100 outputs the boom cylinder command corresponding to a current amount of operation of the boom operation device 33 to the control valve 200. In a case in which the controller 100 determines that the boom-down holding operation of the boom operation device 33 has been performed ("Yes" in step S13), the process proceeds to step S16.

In step S16, the controller 100 determines the target boom stop position on the basis of the storage value.

In step S17, the controller 100 determines the presence or absence of the load in the bucket 12. The controller 100 determines the presence or absence of the load in the bucket 12 on the basis of the signal from work equipment load sensor 71 and the signal from boom angle sensor 72. In a case in which the bucket 12 is determined to be unloaded ("No" in step S17), in step S18, the controller 100 determines a target bucket stop position A on the basis of the storage value (target posture when there is no load) and the target boom stop position determined in step S16. Here, the target bucket stop position A corresponds to a target value of a stop position of the bucket 12 (for example, a stop position of the teeth 12T) when there is no load 20 (in the excavating posture).

On the other hand, in a case in which the bucket 12 is determined to be loaded ("Yes" in step S17), in step S19, the controller 100 determines a target bucket stop position B on the basis of the storage value (target posture when there is a load) and the target boom stop position determined in step S16. Here, the target bucket stop position B corresponds to a target value of the stop position of the bucket 12 (for example, the stop position of the teeth 12T) when there is the load 20 (in the holding posture).

In step S20, the controller 100 outputs the boom cylinder command on the basis of the current boom angle and the target boom angle corresponding to the target boom stop position determined at step S16. In addition, the controller 100 outputs the bucket cylinder command on the basis of the current bucket angle and the target bucket angle corresponding to each of the target bucket stop positions (A or B) determined in steps S18 and S19.

In step S21, the controller 100 determines whether or not a bucket position and a boom position have reached each target stop position. In a case in which at least one of the bucket position and the boom position has not reached the target stop position ("No" in step S21), the determination in step S21 is executed again. On the other hand, in a case in which both of the bucket position and the boom position have reached their respective target stop positions ("Yes" in step S21), the controller 100 ends the processing shown in FIG. 9.

Through the above processing, the controller 100 can determine whether or not there is a load in the bucket 12 in the case in which the boom-down holding operation is performed on the boom operation device 33, and can appropriately determine the target work equipment posture on the basis of the determination result. Further, the controller 100 can cooperatively control the boom cylinder 13 and the bucket cylinder 14 so that the posture of the work equipment 10 becomes the target work equipment posture. Here, the coordinated control is a control that automatically moves the bucket to an angle in accordance with the presence or absence of the load while moving the boom.

Operations and Effects of Embodiment

According to the present embodiment, the target posture of the bucket 12 can be determined appropriately in a case in which the posture of the bucket 12 is automatically controlled.

Also, as a background of the present embodiment, the loading machine (work vehicle) is provided with a plurality of levers for operating the boom, bucket, and the like that constitute the work equipment, and thus complex operations of the work equipment using the plurality of levers may become a burden on a driver. As a countermeasure thereagainst, for example, as described in Patent Document 1, there is a function (kick-out) of attaching a holding mechanism that hold an operation lever in a tilted position to the operation lever and automatically operating work equipment to a fixed position. However, in such a background art, it is not possible to determine work conditions on the basis of the presence or absence of the load in the bucket, and thus, for example, only either an "excavation posture (a running posture during excavation)" or a "posture taken after excavating earth, soil, and the like (a bucket holding posture)," which are frequent and steady work equipment postures, can be automatically operated. Thus, in the present embodiment, work conditions for shifting to next are determined from the presence or absence of the load in the bucket, and the work equipment is controlled to take a steady work equipment posture that matches the work conditions. In that case, in the present embodiment, the presence or absence of the load in the bucket is determined, the target work equipment posture is determined on the basis of the determination result, and the boom and the bucket are cooperatively controlled.

In addition, the present embodiment has the following aspects. (1) The controller 100 of the present embodiment is a device which controls the work equipment 10 having the bucket 12 and the movable support part 17 that changes the position and the posture of the bucket 12, including the bucket loading state estimation unit (determining unit) 103 configured to determine the presence or absence of the load in the bucket 12, and the determination unit 110 that determines the target work equipment posture indicating the target position and the target posture of the bucket 12 on the basis of the determination result of the presence or absence of the load. (2) Also, the controller 100 further includes the control unit 111 that controls the work equipment 10 to achieve the target work equipment posture. (3) Also, the determination unit 110 determines the target work equipment posture such that the bucket 12 is in the holding posture when there is the load 20, and determines the target work equipment posture such that the bucket is in the excavating posture when there is no load 20. (4) Also, in a case in which a predetermined operation is performed on a predetermined operation unit (an operation element such as the boom operation device 33 or a push button) for operating the movable support part 17, the determination unit 110 determines the target work equipment posture. (5) Also, the operation unit of (4) is the operation lever having a function of holding the tilted state, and the predetermined operation can be an operation of holding the operation lever in the tilted state.

Further, the method (control method) of the present embodiment is a method for controlling the work equipment 10 having the bucket 12 and the movable support part 17 that changes the position and the posture of the bucket 12, including a step of determining the presence or absence of the load in the bucket 12 (step S17), and a step of determining the target work equipment posture indicating the target position and the target posture of the bucket on the basis of the determination result on the presence or absence of the load (steps S18 to S20).

Modified Examples of Present Embodiment or Other Embodiments

Although the embodiment of the present invention has been described above with reference to the drawings, the specific configuration is not limited to the above embodiment and includes design changes and the like within the scope of the gist of the present invention.

For example, the wheel loader 1 may be remotely controlled. In this case, part or all of the controller 100 and the operation device 32 can be provided, for example, at a place at which remote control is performed.

Also, for example, the loading machine (or the work vehicle) is not limited to the wheel loader, and can be other loading machine such as a hydraulic excavator including work equipment having a work tool and a movable support part of the work tool. For example, in a case in which the loading machine is a hydraulic excavator, for example, when the position of the bucket is changed during loading work of earth or the like, the bucket, the arm, and the boom are cooperatively controlled such that the posture of the bucket is in the holding posture while the position of the bucket is changed when the bucket is in the loaded state, and the posture of the bucket is in the excavating posture while the position of the bucket is changed when the bucket is in an empty state.

In addition, the movable support part is not limited to one that changes the position and the posture of the bucket 12, but may be one that changes the posture of the bucket 12. In this case, the target work equipment posture can be set to indicate the target posture, and the determination unit 110 can be set to determine the target work equipment posture that indicates the target posture. Also, the work tool is not limited to the bucket. The work machine may be, for example, a fork, a bale grab, or the like that is replaceably attached to the wheel loader as an attachment.

Also, part or all of programs executed by a computer in the above embodiments can be distributed via computer-readable recording media or communication lines.

According to each aspect of the present invention, it is possible to appropriately determine the target posture of the work tool when the posture of the work tool is automatically controlled.

The invention claimed is:

1. A control system for controlling a wheel loader,
the wheel loader having work equipment,
the work equipment including a work tool and a movable support part configured to change a posture of the work tool,
the movable support part including a boom and a bucket cylinder configured to drive the work tool with respect to the boom,
the posture of the work tool being an angle of the work tool with respect to the boom,
the control system comprising:
at least one memory storing instructions; and
at least one processor configured to execute the instructions,
the at least one processor being configured to
determine presence or absence of a load accommodated in the work tool, and
determine a target work equipment posture indicating a target posture of the work tool based on a determination result of the presence or absence of the load, wherein
in a case in which there is an operation of lowering the work tool and it is determined that the load is present, the at least one processor determines the target work implement posture to be a holding posture for holding the load in the work tool, or
in a case in which there is an operation of lowering the work tool and it is determined that the load is not present, the at least one processor determines the target work implement posture to be an excavating posture for starting excavation.

2. The control system controlling a wheel loader according to claim 1, wherein the movable support part is further configured to change a position of the work tool, and the target work equipment posture indicates the target posture of the work tool and a target position of the work tool.

3. The control system for controlling a wheel loader according to claim 1, wherein the at least one processor is further configured to output a command to control the movable support part to achieve the target work equipment posture.

4. The control system for controlling a wheel loader according to claim 1, wherein the work tool is a bucket, and the at least one processor is further configured to determine the presence or absence of the load in the bucket.

5. A wheel loader comprising:

work equipment including a work tool and a movable support part configured to change a posture of the work tool;

an operation unit configured to operate the movable support part;

at least one memory storing instructions; and at least one processor configured to execute the instructions, the movable part including a boom and a bucket cylinder configured to drive the work tool with respect to the boom, the posture of the work tool being an angle of the work tool with respect to the boom, the at least one processor being configured to determine presence or absence of a load, determine a target work equipment posture indicating a target posture of the work tool based on a determination result of the presence or absence of the load, and output a command to control the movable support part to achieve the target work equipment posture, wherein in a case in which there is an operation of lowering the work tool and it is determined that the load is present. the at least one processor determines the target work implement posture to be a holding posture for holding the load in the work tool, or in a case in which there is an operation of lowering the work tool and it is determined that the load is not present, the at least one processor determines the target work implement posture to be an excavating posture for starting excavation.

6. The loading machine according to claim 5, wherein the movable support part is further configured to change a position of the work tool, and the target work equipment posture indicates the target posture of the work tool and a target position of the work tool.

7. The control system for controlling a wheel loader according to claim 1, further comprising:

an operation part configured to operate the movable support part, the at least one processor being further configured to determine the target work equipment posture in response to a predetermined operation performed on the operation unit.

8. The control system for controlling a wheel loader according to claim 7, wherein the operation unit is an operation lever having a function of holding a tilted state, and the predetermined operation is an operation to hold the operation lever in the tilted state.

9. A method performed by a controller system configured to control a wheel loader, the wheel loader having work equipment, the work equipment including a work tool and a movable support part configured to change a posture of the work tool, the movable support part including a boom and a bucket cylinder configured to drive the work tool with respect to the boom, the posture of the work tool being an angle of the work tool with respect to the boom, the method comprising:

determining presence or absence of a load accommodated in in the work tool; and determining a target work equipment posture indicating a target posture of the work tool based on a determination result of the presence or absence of the load, wherein in a case in which there is an operation of lowering the work tool and it is determined that the load is present. the target work implement posture is determined to be a holding posture for holding the load in the work tool, or in a case in which there is an operation of lowering the work tool and it is determined that the load is not present, the target work implement posture is determined to be an excavating posture for starting excavation.

10. The method according to claim 9, wherein the movable support part is further configured to change a position of the work tool, and the target work equipment posture indicates the target posture of the work tool and a target position of the work tool.

11. The method according to claim 9, further comprising:

outputting a command to control the movable support part to achieve the target work equipment posture.

* * * * *